US006390833B1

(12) United States Patent
Chang

(10) Patent No.: US 6,390,833 B1
(45) Date of Patent: May 21, 2002

(54) ELECTRICAL CONNECTOR WITH IMPROVED ESD AND TERMINAL ARRANGEMENT

(75) Inventor: Jen Jou Chang, Yung-Ho (TW)

(73) Assignee: Hon Hai Precision Ind. Co., Ltd., Taipei Hsiena (TW)

( * ) Notice: Subject to any disclaimer, the term of this patent is extended or adjusted under 35 U.S.C. 154(b) by 0 days.

(21) Appl. No.: 09/854,338

(22) Filed: May 11, 2001

(30) Foreign Application Priority Data

Feb. 27, 2001 (TW) ..... 90202954 U

(51) Int. Cl.[7] ..... H01R 13/652
(52) U.S. Cl. ..... 439/108; 439/609
(58) Field of Search ..... 439/108, 607, 439/608, 609, 660, 74, 92

(56) References Cited

U.S. PATENT DOCUMENTS 5,035,631 A * 7/1991 Piorunneck et al. ..... 439/108
5,913,690 A * 6/1999 Dechelette et al. ..... 439/108
5,993,257 A * 11/1999 Maruyama ..... 439/607
6,247,970 B1 * 6/2001 Ueno et al. ..... 439/608

* cited by examiner

*Primary Examiner*—Hien Vu
(74) *Attorney, Agent, or Firm*—Wei Te Chung

(57) ABSTRACT

An electrical connector assembly (100) including a female connector (10) and a male connector (20). The female connector includes a housing (11), a plurality of female terminals (14), a pair of female auxiliary terminals (15), a shield (13), and a pair of metallic grounding pads (17). Each grounding pad provides a contacting portion (174) exposed from opposite ends of the housing for electrically engaging with a shield (23) of the male connector. Furthermore, the female terminals are positioned on side walls (123) of the housing while the female auxiliary terminals are located on an inner side (1250) perpendicular to the side walls. The male connector accordingly provides a plurality of male terminals (24) positioned on a pair of male tongues (221) thereof for engaging with the female terminals and a pair of male auxiliary terminals (25) located on a bridge wall (223) perpendicularly interconnecting the male tongues for engaging with the female auxiliary terminals.

10 Claims, 6 Drawing Sheets

ELECTRICAL CONNECTOR WITH IMPROVED ESD AND TERMINAL ARRANGEMENT

BACKGROUND OF THE INVENTION

1. Field of the Invention

The present invention relates to an electrical connector and particularly to an electrical connector having a pair of grounding pads for Electro-Static Discharge (ESD) and having a pair of terminals arranged in a first wall which is perpendicular to second walls on which a plurality of terminals are disposed.

2. Description of Related Art

A conventional connector usually provides a metallic bus projecting upwardly from a mating opening of the connector into which a complementary connector is received. The bus is applied to discharge electrons deposited on a complementary connector. Obviously, the bus should be spaced from the terminals and thus requires the mating opening to be wide enough to accommodate both the terminals and the bus. For high density connectors which have several rows of terminals, such a large mating opening deteriorates the scarce port area of the connector. On the other hand, it is usual to arrange signal terminals on parallel walls. Thus when the number of the terminals is increased, there is a requirement for longer walls on which the terminals are located. Such requirement sacrifices length of the connector. Therefore, it is desirable to add terminals without extending the length of the connector.

SUMMARY OF THE INVENTION

Accordingly, the object of the present invention is to provide an electrical connector having grounding pads for ESD, the grounding pads requiring no additional space in the connector.

Another object of the present invention is to provide an electrical connector having terminals distributed in walls of a housing thereof perpendicular relative to each other so as to remain the connector compact.

In order to achieve the objects set forth, an electrical connector assembly comprises a male connector and a female connector mateable with the male connector.

The female connector includes a dielectric female housing, a plurality of metallic female terminals, a pair of grounded grounding pad for ESD, and a conductive female shield attached to an outer side of the housing. The male connector includes a dielectric male housing, a plurality of male terminals, and a conductive shield.

The female housing has a longitudinal mating wall and defines a female receiving opening in the mating wall. The mating wall provides two blocks at opposite ends thereof and an elongated female tongue formed amidst the female receiving opening and being parallel to opposite side walls of the mating wall. The female terminals are lined up on the side walls of the mating wall and opposite sides of the male tongue. Each block defines a cavity extending upwardly through the mating wall for receiving the grounding pads. Each grounding pad has a first feet abutting against the shield from the cavity and a second feet exposed over the cavity. The second feet provides a contacting portion for electrically as well as mechanically engages with the shield before the female and male terminals engage with each other.

The male housing defines a male receiving opening and forms a pair of male tongues parallelly projecting in the male receiving opening and a bridge wall interconnecting adjacent ends of the male tongues. The female tongue of the female connector is received between the male tongues and the bridge wall. The male tongues forming engaging surfaces which are engageable with the side walls of the mating wall and opposite sides of the female tongue of the female connector. The bridge wall forms a contacting surface angularly connecting with the engaging surface and mates with the inner side of one of the block. The male terminals are arranged along the engaging surface of the male board and are electrically engaged with corresponding female terminals of the female connector.

Other objects, advantages and novel features of the invention will become more apparent from the following detailed description when taken in conjunction with the accompanying drawings.

BRIEF DESCRIPTION OF THE DRAWINGS

FIG. 9 is similar to FIG. 8, showing an engagement between the

DETAILED DESCRIPTION OF THE INVENTION

Figure 1:
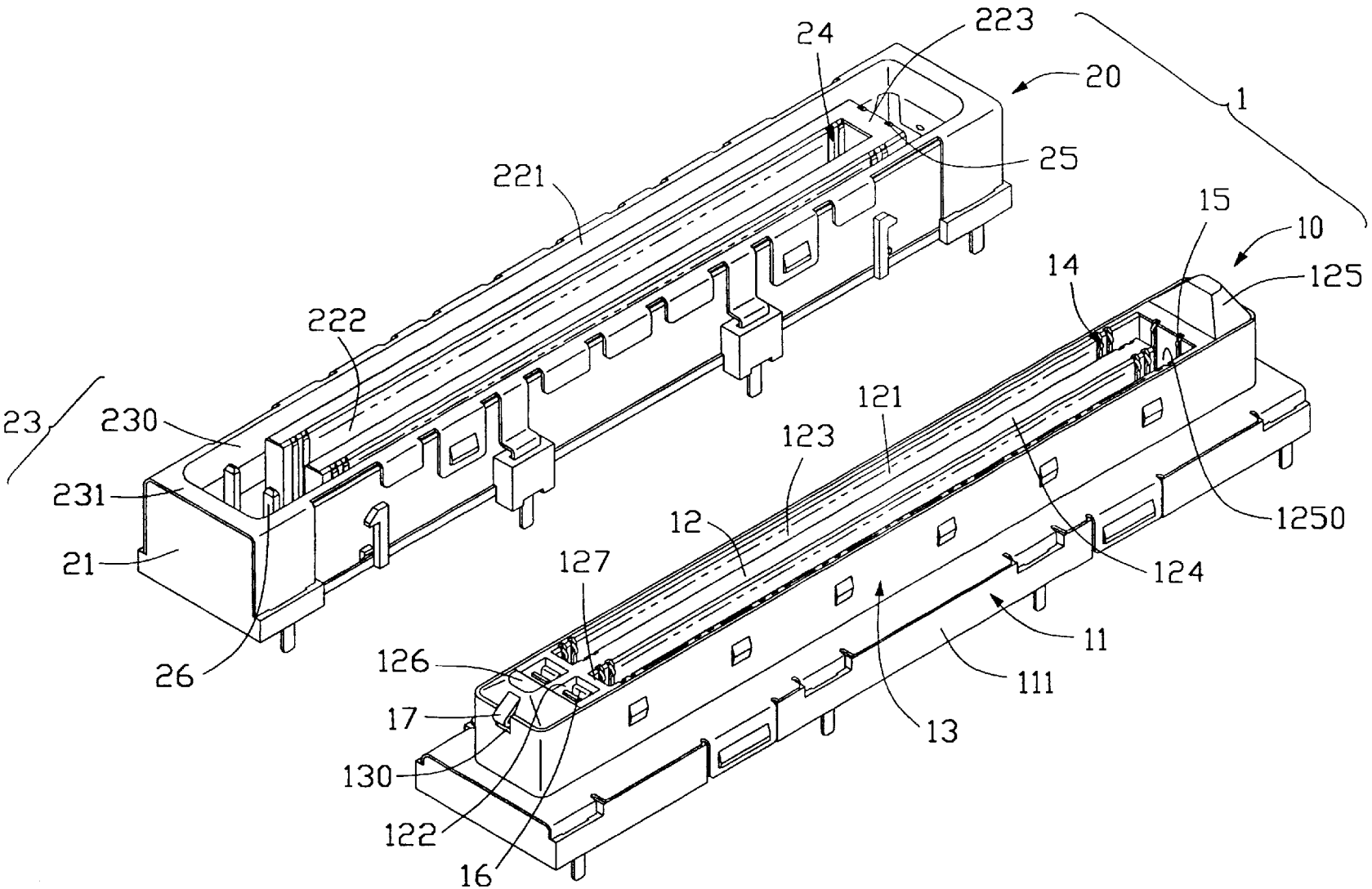
FIG. 1 is a perspective view of an electrical connector assembly in accordance with the present invention, the connector assembly including a female connector and a male connector.

Referring to FIG. 1, an electrical connector assembly 1 of the present invention comprises a female connector 10 and a male connector 20 engageable with the female connector 10.

Figure 2:
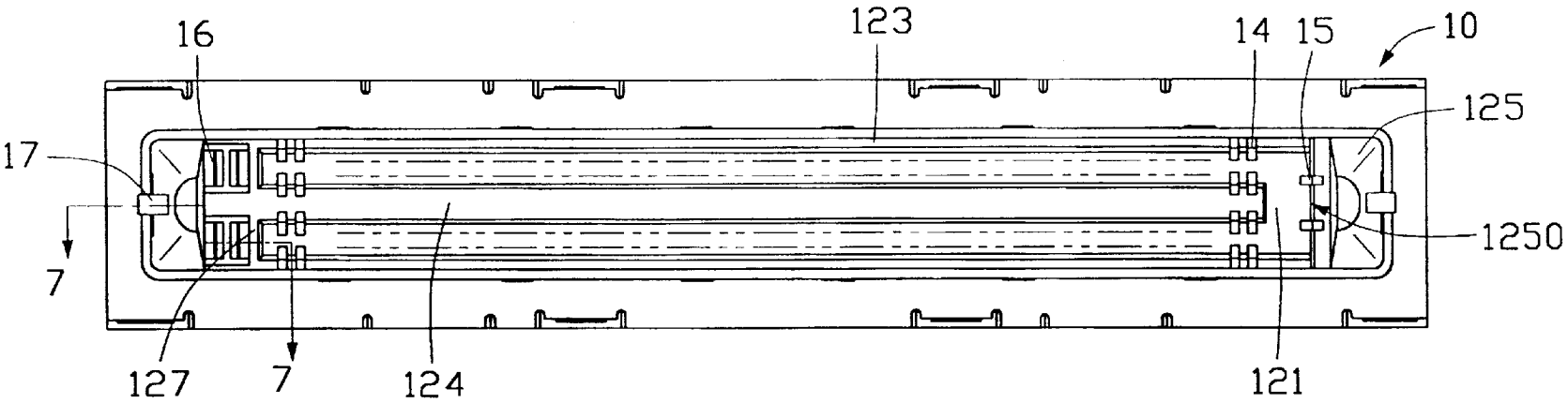
FIG. 2 is a top view of the female connector of FIG. 1.
Figure 3:
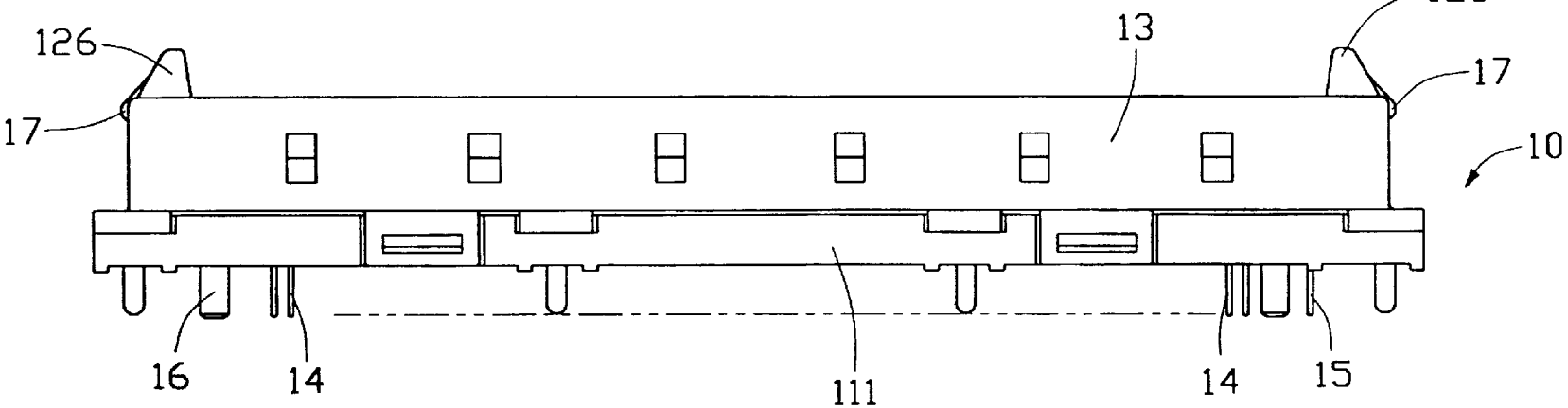
FIG. 3 is a side view of the female connector of FIG. 2.
Figure 4:
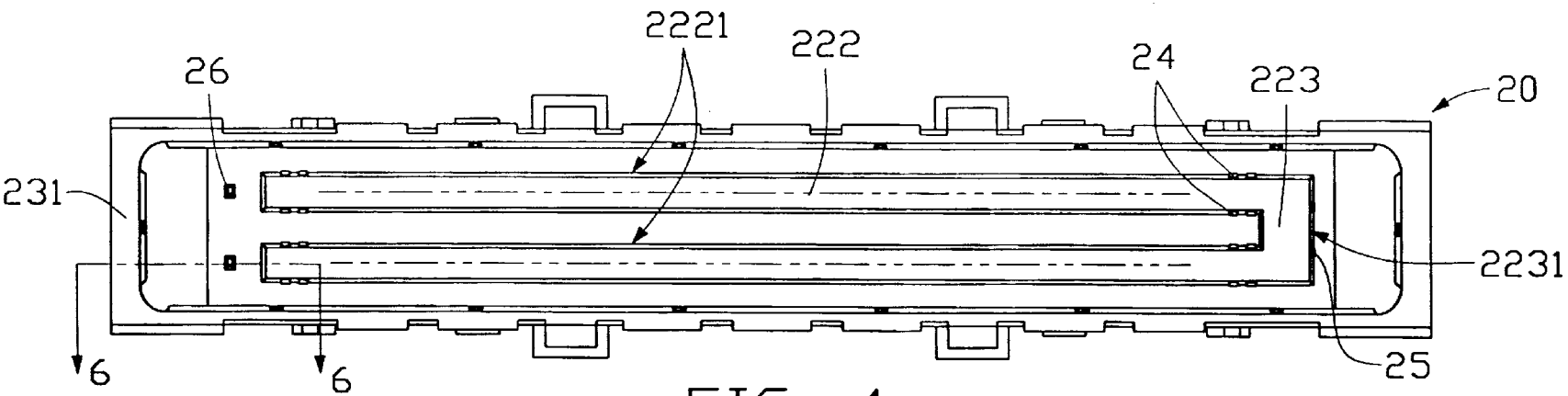
FIG. 4 is a to view of the male connector of FIG. 1.
Figure 5:
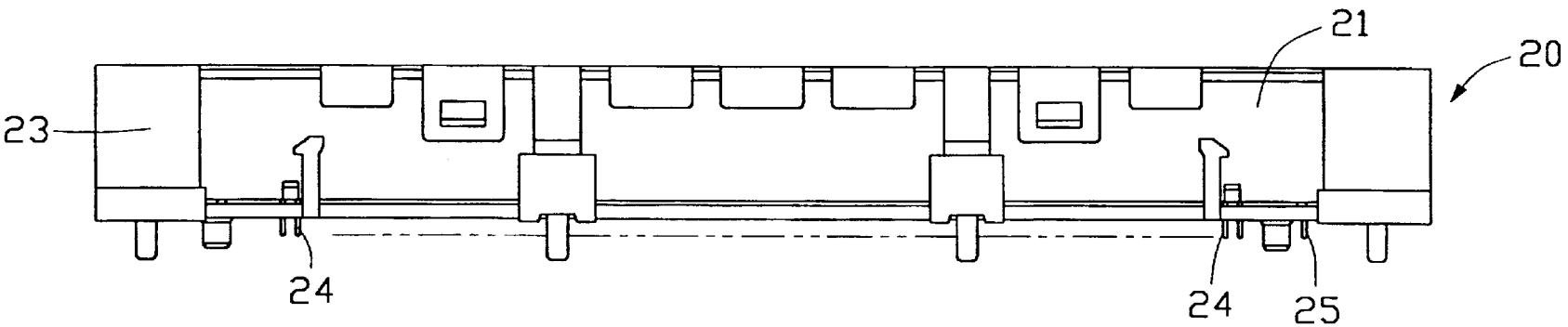
FIG. 5 is a side view of the male connector of FIG. 4.
Figure 6:
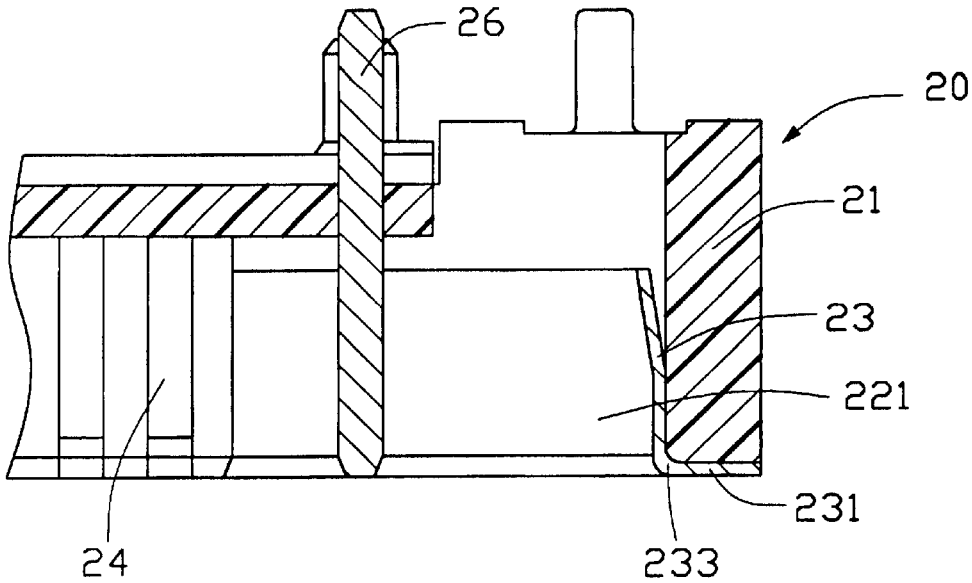
FIG. 6 is a cross-sectional view of a portion of the male connector, taken along line 6—6 of FIG. 4.

Further referring to FIGS. 2 and 3, the female connector 10 includes an insulative female housing 11, a plurality of female terminals 14 received in the female housing 11, a pair of metal first power pins 16 located at an opposite end of the female housing 11, a pair of conductive grounding pads 17 (only one is shown), and a metallic female shield 13 latching to an outer side of the female housing 11.

The insulative female housing 11 includes a base wall 111 and a mating wall 12 projecting upwardly from the base wall 111. The mating wall 12 defines, between a distal block 125 and a proximate block 126 opposing the distal block 125, a longitudinal first receiving opening 121 and a pair of second receiving openings 122 separated from the first receiving opening 121 by a baffle wall 127. Two rows of female terminals 14 protrude into the first receiving opening 121 from opposite side walls 123 of the mating wall 12 for transmitting signal data. Moreover, two auxiliary female terminals 15 are individually located on an inner side 1250 of the distal block 125, which is perpendicular to the side walls 123 of the mating wall 12, and protrude into the first receiving opening 121. A female tongue 124 extends from the baffle wall 127 toward the distal block 125. Conventionally, two rows of female terminals 14 are arranged in opposite outer sides of the female tongue 124, aligning with the female terminals 14 in the side walls 123. Accordingly, the first receiving opening 121 is U-shaped as is best indicated in FIG. 2. The second receiving openings 122 each accommodate a conductive power clip 16 which is able to resiliently deform in a longitudinal orientation of the mating wall 12.

Figure 7:
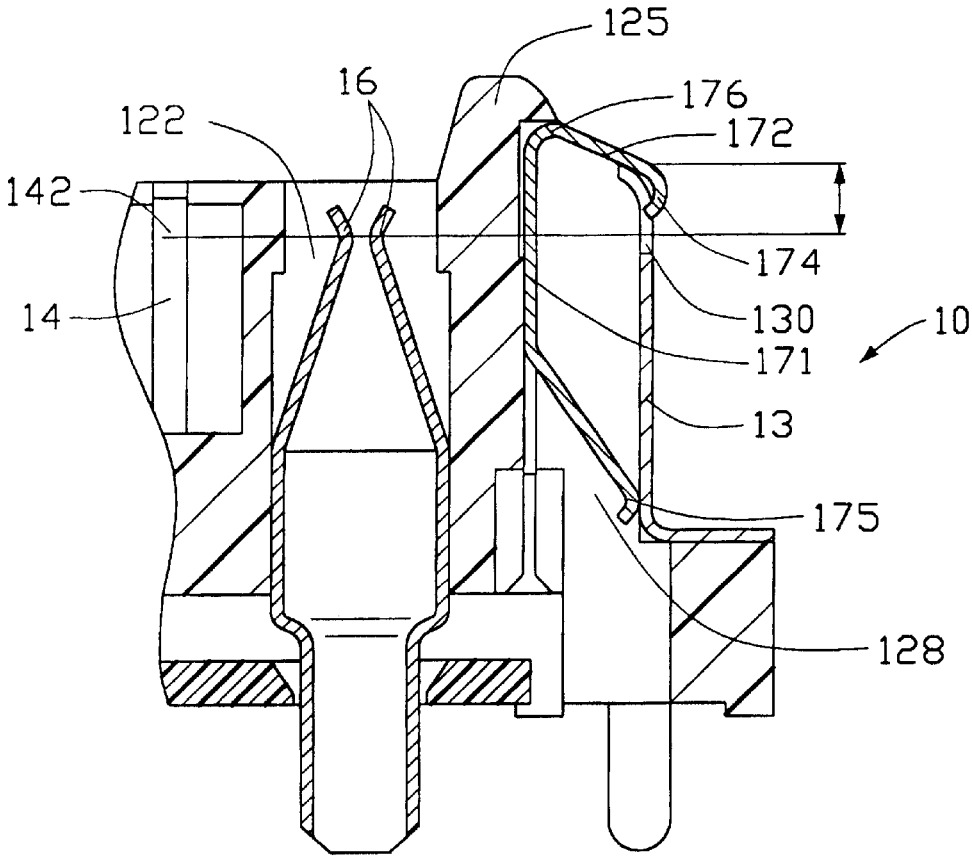
FIG. 7 is a cross-sectional view of a portion of the female connector, taken along line 7—7 of FIG. 2.

Further referring to FIG. 7, each block 125, 126 defines a cavity 128 (only one is shown) extending upwardly from a bottom surface of the base wall 11 through the mating wall 12 so that the grounding pads 17 can be inserted thereinto. The cavities 128 open to air from outer sides of the blocks 125, 126, which are also outer sides of the mating wall 12, whereby the grounding pads 17 can touch the shield 13 surrounding the mating wall 12 from the opens. Each grounding pad 17 has a body 171 abutting against a corresponding block 125, 126, a first foot 175 extending downwardly and outwardly from a lower end of the body 171 and electrically as well as mechanically pressing against an inner side of the female shield 13, a second foot 172 downwardly and outwardly joining with the body 171 at a juncture 176, and a contacting portion 174 formed on the second foot 172. The contacting portion 174 slightly protrudes beyond the female shield 13 from a cutout 130 of the female shield 13 which is defined in an upper edge of the shield 13. It is noted that the contacting portions 174 of the grounding pads 17 are located above engaging portions 142 of the terminals 14, 15 which are capable of electrically and mechanically engaging with corresponding terminals of the male connector 20. In addition, the junctures 176 upwardly abut against the blocks 125, 126 and the first feet 175 induce friction between the female shield 13 and the grounding pads 17, thereby positioning the grounding pads 17 in the cavities 128.

As is shown in FIGS. 1, 4, 5 and 6, the male connector 20 comprises a dielectric male housing 21, a plurality of male terminals 24, a pair of power contacts 26, and a metallic male shield 23 attached to the male housing 21.

The male housing 21 is elongate and defines an upward facing slot 221. Two parallel arranged male tongues 222 are located in the slot 221 with their distal ends being perpendicularly interconnected by a bride wall 223. Thus, the male tongues 222 and the bridge wall 223 are adapted to be received in the U-shaped first receiving opening 121. Each male tongue 222 defines engaging surfaces 2221 on opposite sides thereof and the bridge wall 223 defines a contacting surface merely on a side facing the distal block 125. The male terminals 24 are positioned on the engaging surface 2221 of the male tongues 222 whereas two auxiliary male terminals 25 are symmetrically positioned on the contacting surface 2231. The engaging surfaces 2221 are defined on lateral sides of and the contacting surface 2231 faces the distal block 125. The power contacts 26 are located at an end of the slot 221 far away from the bridge wall 223.

The male shield 23 has a peripheral wall 230 wrapping an inner side of the slot 221 and two flanges 231 covering opposite upper surfaces of the housing 21. The flanges 231 perpendicularly join to the peripheral wall 230 at joints 233.

Figure 8:
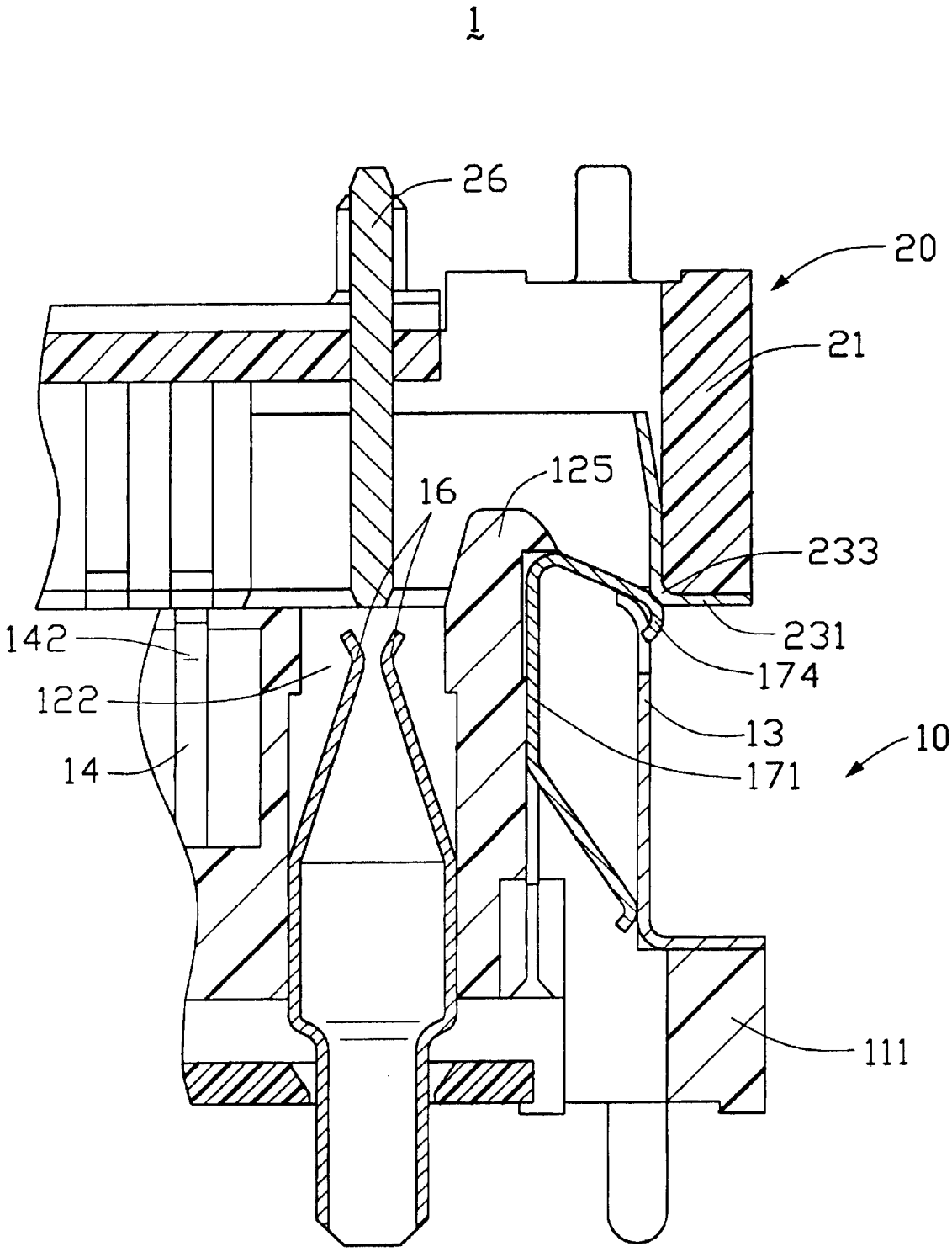
FIG. 8 is a cross-sectional view of the portions of FIG. 6 and FIG. 7.
Figure 9:
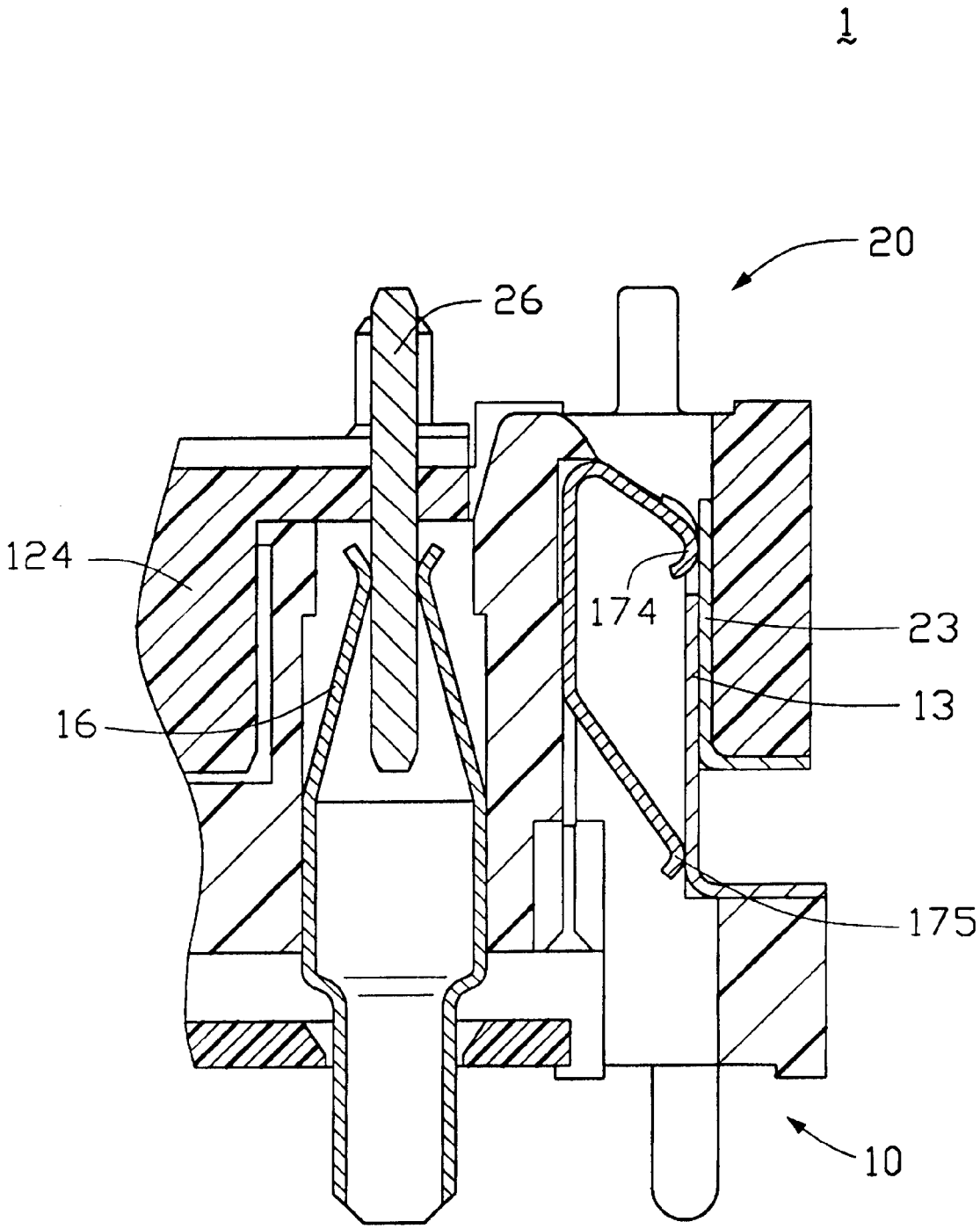

When the female and male connectors 10, 20 are engaged, as is shown in FIGS. 8 and 9, the male connector 20 is pressed downwardly such that the joints 233 of the male shield 23 touch the contacting portions 174 of the grounding pads 17 on the female connector 10 before the terminals 24, 25 of the male connector 20 and the power contacts 26 of the male connector 20 engage with corresponding terminals 14, 15 and the power clips 16 of the female connector 10. Therefore, the static electrons deposited on the male connector 20 are discharged prior to data transmitting and power current flowing between the female and male connector 10, 20. As the male connector 20 is mounted to the female connector 10, the second feet 172 of the grounding pads 17 are forced to be received in the cavities 128 by friction. The two male tongues 222 sandwiches the female tongue 124 so that the female terminals 14 engage with the corresponding male terminals 24 for data transmitting. Meanwhile, the contacting surface 2231 of the bridge wall 25 engages with the inner side 1250 of the distal block 125 such that the auxiliary female terminals 15 engage with corresponding auxiliary male terminals 25 for data transmitting. The power contacts 26 of the male connector 20 are clipped by the power clips 16 of the female connector 10 for power current flowing therethrough.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector, the complementary connector having a shield on peripheral sides of an opening thereof, comprising:

a dielectric housing having an elongated mating wall which defines a receiving opening, the mating wall being adapted to be received in the opening of the complementary connector;

a plurality of terminals being positioned in the mating wall and exposed to the receiving opening and having engaging portions engageable with corresponding terminals of the complementary connector; and a conductive grounding pad being secured to an end of the mating wall at a position outside the receiving opening, the grounding pad having a contacting portion projecting outwardly from the mating wall, the contacting portion being located above the engaging portions of the terminals for electrically and mechanically engaging with the shield of the complementary connector, wherein the contacting portion mates with the shield of the complementary connector before the engaging portions of the terminals engage with corresponding terminals of the commentary connector; wherein the mating wall forms an upward extending block which has an inner side facing the receiving opening, the block defining a cavity in an outer side opposite the inner side thereof, the cavity extending upwardly through the mating wall and opening to the outer side of the block; wherein the contacting portion of the grounding pad is exposed from the cavity; wherein the connector firer comprises a conductive shield enclosing the mating wall, the grounding pad being received in the cavity and touching against an inner side of the shield from the outer side of the block.

2. The electrical connector as described in claim 1, wherein the grounding pad has a body abutting against the block, a first foot extending downwardly and outwardly from one end of the body and electrically as well as mechanically mating with an inner side of the shield, and a second foot extending from another end of the body and providing the contacting portion for electrically engaging with the shield of the complementary connector.

3. The electrical connector as described in claim 2, wherein the shield defines a cutout at an upper edge of a lateral side thereof, from which the contacting portion of the second foot protrudes outwardly.

4. An electrical connector assembly comprising:

female connector including:

a dielectric female housing, the female housing having a longitudinal mating wall forming upward extending blocks and defining a female receiving opening in the mating wall, the mating wall having a first wall and a second wall which face the receiving opening;

a plurality of female terminals lining up on the first wall of the mating wall; and a female auxiliary terminal mounted on the second wall of the mating wall; and a male connector mateable with the female connector, including:

a dielectric male housing, the male housing defining a male receiving opening and forming a male board projecting in a middle of the male receiving opening, the male board being received in the female receiving opening of the female connector, the male board forming an engaging surface which engages with the first wall of the mating wall of the female connector and a contacting surface which is angular relative to the engaging surface and is engaged with the second wall of the mating wall of the female connector;

a plurality of male terminals arranged along the engaging surface of the male board and electrically engaging with corresponding female terminals of the female connector; and a male auxiliary terminal being positioned on the contacting surface of the male board and electrically engaging with the female auxiliary terminal of the female connector; wherein the female connector forms a female board in a middle of the female receiving opening thereof, the female board being parallel to but spaced from the first wall; wherein the male board has a pair of male tongues and a bridge wall interconnecting the male tongues; wherein the female board is received between the male tongues and the bridge wall, whereby the female terminals and the female auxiliary terminal respectively engage with corresponding male terminals the male auxiliary terminal; wherein the female connector further comprises a metal shield enclosing the mating wall, and a pair of grounding pads located on the blocks at opposite ends thereof and wherein the male connector comprises a conductive shield, the grounding pads electrically and mechanically mating with the shield for Electro-Static Discharge.

5. The electrical connector assembly as described in claim 4, wherein the male board has a male tongue on which a plurality of male terminals is positioned and a bridge wall angularly connected to an end of the male tongue.

6. The electrical connector assembly as described in claim 5, wherein the engaging surface is defined on the male tongue and the contacting surface is defined on the bridge wall.

7. The electrical connector assembly as described in claim 5, wherein the female board is engageable with the male tongue and the bridge wall.

8. The electrical connector assembly as described in claim 4, wherein the female housing of the female connector defines a pair of cavities for receiving the grounding pads, the cavities being opened to outer sides of the female housing and being surrounded by a shield of the female connector, the grounding pads abutting against an inner side of the shield for being grounded.

9. An electrical connector assembly comprising:

a female connector including:

a dielectric female housing, the female housing having a longitudinal mating wall forming upward extending blocks and defining a female receiving opening in the mating wall, the female mating wall having a pair of parallel first walls and a second wall facing the receiving opening, the second wall angularly connecting with the first walls, an elongated female tongue being formed in a middle of the female receiving opening and being parallel to the first walls; and a plurality of female terminals lining up on opposite sides of the female tongue; and a male connector mateable with the female connector, including: a dielectric male housing, the male housing defining a male receiving opening and forming a pair of male tongues parallelly projecting in the male receiving opening and a bridge wall interconnecting adjacent ends of the male tongues, the female tongue being received between the male tongues and the bridge wall, the male tongues forming engaging surfaces which are engageable with opposite sides of the female tongue of the female connector, the bridge wall forming a contacting surface mating with the second wall of the mating wall of the female connector; and a plurality of male terminals arranged along the engaging surfaces of the male tongues and electrically engaging with corresponding female terminals of the female connector; further comprising a male auxiliary terminal positioned on the contacting surface of the male board and electrically engaging with a female auxiliary terminal of the female connector which is located on the second wall of the female connector; wherein the female connector further comprises a metal shield enclosing the mating wall and a pair of grounding pads located on the blocks at opposite ends thereof and wherein the male connector comprises a conductive shield, the grounding pads electrically and mechanically mating with the shield for Electro-Static Discharge.

10. The electrical connector assembly as described in claim 9, wherein the female housing of the female connector defines a pair of cavities for receiving the grounding pads, the cavities being opened to outer sides of the female housing and being surrounded by a shield of the female connector, the grounding pads abutting against an inner side of the shield for being grounded.

* * * * *